United States Patent [19]

Meilman et al.

[11] Patent Number: 4,616,556

[45] Date of Patent: Oct. 14, 1986

[54] FLEXIBLE COMPRESSIBLE PISTON

[76] Inventors: Anna Meilman, 514 W. Cherry Hill Apartments, Cherry Hill, N.J. 08002; Sergey Meilman, Apartment E-5, 1865 Welsh Rd., Philadelphia, Pa. 19115; Piotr Meilman, 514 W. Cherry Hill Apartments, Cherry Hill, N.J. 08002

[21] Appl. No.: 610,124

[22] Filed: May 14, 1984

[51] Int. Cl.[4] ..... F01B 19/00

[52] U.S. Cl. ..... 92/48; 92/90; 417/475

[58] Field of Search ..... 92/89, 90, 48, 137, 92/249; 60/594; 417/437, 475

[56] References Cited

U.S. PATENT DOCUMENTS

| | | | |
|---|---|---|---|
| 3,315,606 | 4/1967 | Piros | 92/48 |
| 3,471,668 | 10/1969 | Wilkes | 92/89 |
| 4,449,443 | 5/1984 | Föhl | 92/137 |

FOREIGN PATENT DOCUMENTS

| | | | |
|---|---|---|---|
| 1355651 | 6/1974 | United Kingdom | 92/90 |
| 791989 | 12/1980 | U.S.S.R. | 60/473 |
| 937801 | 6/1982 | U.S.S.R. | 92/89 |

*Primary Examiner*—Abraham Hershkovitz
*Attorney, Agent, or Firm*—Norman E. Lehrer

[57] ABSTRACT

Apparatus for selectively creating a vacuum or increasing pressure or for converting pressure forces into mechanical motion includes a pair of substantially cylindrical housings, each having an airtight chamber therein. A length of a flexible sheet-like material has each end spirally wound around an axle in each of the chambers and extends out through openings in the housings. The sheet-like material functions as a piston and an airtight seal is formed between the material and the opening in each housing. As the axle in one chamber is turned to draw the piston into that chamber, the pressure within the chamber increases. However, when the piston is withdrawn from the chamber, the pressure in the chamber decreases. Alternatively, pressure in one of the chambers can be changed from an outside source thereby drawing the piston into and out of the chambers. This causes the axles of the chambers to rotate. Other structural embodiments of the invention are also disclosed.

2 Claims, 9 Drawing Figures

FLEXIBLE COMPRESSIBLE PISTON

BACKGROUND OF THE INVENTION

The present invention is directed toward a pump or motor or similar device for converting motion into pressure and pressure into motion and more particularly toward such devices which employ a flexible piston.

Vacuum and pressure pumps have been known and used for a very long time. The majority of these pumps utilize a piston and cylinder arrangement wherein a solid piston is forced into or out of a cylindrically shaped chamber. The outer circumference of the piston is substantially identical to the inner configuration of the cylinder so that air or other fluid within the cylinder is compressed when the piston is moved into the cylinder. In the reverse direction, the air or other fluid in the cylinder is reduced in pressure. Various known valve arrangements and input and output ports control the amount of vacuum or pressure and allow the same to be put to some desired use. With similar known arrangements, increasing or decreasing pressure can result in mechanical motion of the piston; thus utilizing such devices as motors.

The basic principles under which such devices operate have remained substantially the same over the years despite many technical advancements in other fields. To Applicants' knowledge, the pistons utilized with such devices have always been substantially rigid. No one, to Applicants' knowledge, has ever comtemplated the use of a truly flexible piston.

SUMMARY OF THE INVENTION

The present invention is directed toward a device which can be used for creating a vacuum or for increasing pressure or for converting pressure forces into mechanical motion and can be used in substantially the same manner as other conventional pumps and motors. The present device, however, does not utilize a solid or rigid piston. The apparatus includes a pair of substantially cylindrical housings each of which has an airtight chamber therein. A length of a flexible sheet-like material has each end spirally wound around an axle in each of the chambers and extends out through openings in the housings. The sheet-like material functions as a piston and an airtight seal is formed between the material and the opening in each housing. As the piston is withdrawn from one airtight chamber, the pressure in that chamber decreases. When the axle in the airtight chamber is turned to draw the piston into that chamber, the pressure within the chamber increases. Alternatively, pressure in one of the chambers can be decreased or increased from an outside source thereby drawing the piston in or forcing it out and thus creating motion.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
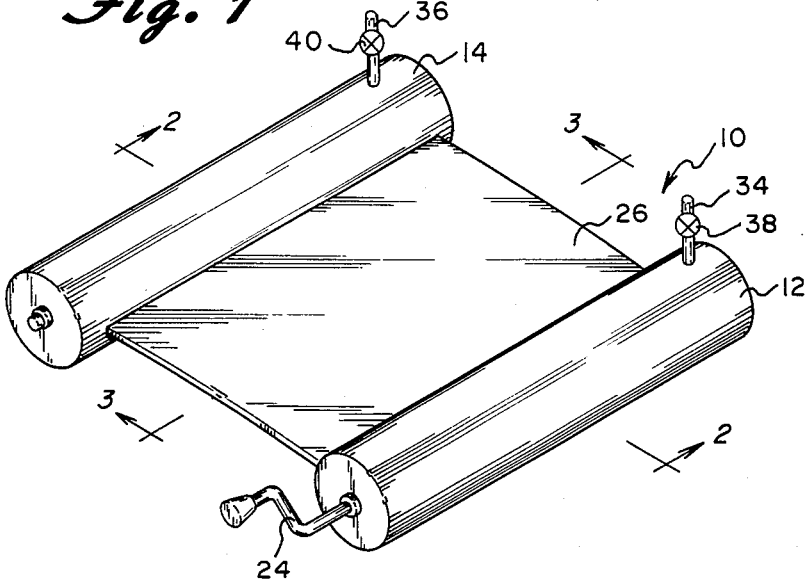
FIG. 1 is a perspective view of a simplified form of an apparatus for creating a vacuum or increasing pressure constructed in accordance with the principles of the present invention.

Referring to the drawings wherein like reference numerals have been used throughout the various figures to designate like elements, there is shown in FIG. 1 a perspective view of an apparatus for creating a vacuum or increasing pressure constructed in accordance with the principles of the present invention and designated generally as 10. It should be understood that the apparatus shown in FIG. 1 is being shown basically diagrammatically for the purpose of demonstrating the principles of the present invention. It will be readily apparent to those skilled in the art that the same principles could be applied to substantially more complex devices.

The pump apparatus 10 includes a pair of substantially cylindrically shaped tubular housings 12 and 14. Each housing includes an airtight chamber therein such as shown at 16 and 18 in FIG. 2. Rotatable axles 20 and 22 are mounted within the chambers 16 and 18, respectively. Means such as a handle 24 extends outside of the housing 12 but is connected to the axle 20 for rotating the same. The connection between the handle 24 and the axle 20 is, of course, air tight. It should be understood that the handle 24 is shown by way of example only. The handle could be replaced by a gear or pulley or some other piece of machinery which would impart rotary motion to the axle 20. Furthermore, while a handle is not shown connected to the axle 22 of housing 14, this has been done for illustration purposes only. A similar handle or other rotation generating means would be provided on the housing 14 for rotating the axle 22.

Figure 3:
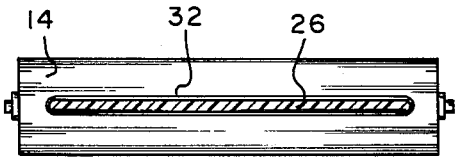
FIG. 3 is a cross-sectional view taken through the line 3—3 of FIG. 1.

A flexible piston 26 in the form of a long sheet of nonporous material extends between the housings 12 and 14. The piston 26 may have a rectangular or oval cross section such as shown in FIG. 3 and has a constant cross-sectional configuration throughout its entire length. Preferably, the piston 26 is comprised of a plastic material such as Teflon or the like having an extremely smooth outer surface.

Figure 2:
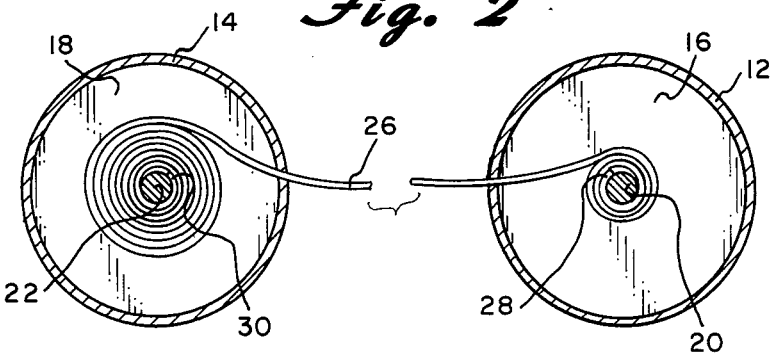
FIG. 2 is a cross-sectional view taken through the line 2—2 of FIG. 1.

A first end 28 of the piston 26 is secured to the axle 20. Similarly, the other end 30 of the piston 26 is secured to the axle 22. As the axles are rotated, the flexible sheet-like piston 26 wraps around the respective axle in a spiral-like manner such as shown in FIG. 2. The length and thickness of the material comprising the piston 26 is selected so that when substantially all of the material is spirally wrapped around one of the axles, the material takes up substantially all of the volume of the chamber within the respective housing.

As shown most clearly in FIG. 3, the piston 26 is drawn into or is withdrawn from the housing 14 into the chamber 18 through an opening 32 in the side wall of the housing 14. The shape of the opening 32 is selected to be complementary to the cross section of the piston 26. Although the opening 32 in FIG. 3 is shown to be slightly larger than the piston 26, this is for illustration purposes only. In operation, the opening 32 and cross-sectional configuration of the piston 26 must be of the identical size so that an airtight seal is created therebetween. The housing 14 can be constructed of various different materials such as metal, glass or rigid plastic. If the materials from which the housing 14 and the piston 26 are manufactured are properly selected, an adequate airtight seal may be created between the walls of the opening 32 and the piston 26. It may, however, be necessary to employ an additional sealing member and/or utilize a sealing medium such as grease or the like between the walls of the opening 32 and the piston 26.

Although not specifically shown, it should be understood that the housing 12 is similarly provided with an opening through which the piston 26 can pass. Furthermore, two housings may have the same opening. Both housings are also provided with ports 34 and 36 having valves 38 and 40 therein. The ports 34 and 36 are the only communication to the chambers 16 and 18, respectively. Otherwise, the chambers are airtight.

The device shown in FIG. 1 operates in the following manner. Preliminarily, the entire piston 26 will be spirally wrapped around the axle 22. If it is desired to generate a vacuum or reduced pressure, valve 38 in port 34 is opened and valve 40 in port 36 is closed. It can be seen that, under these circumstances, there is air in the chamber 16 which is in communication with the outside air through port 34. On the other hand, there is only a very small amount of air in chamber 18 which is not in communication with the outside atmosphere.

As handle 24 is then turned, axle 20 turns and the piston 26 is drawn into the chamber 16 as it wraps itself around the axle 20. The piston 26 entering the chamber 16 displaces the air that was within the chamber and forces it out through the port 34. On the other hand, the piston 26 is being withdrawn from the chamber 18 as it is pulled therefrom and unwraps itself from the axle 22. The small amount of air that was in the chamber 18, therefore, is left with a much greater space to fill thereby creating a vacuum or substantially reducing the pressure within the chamber 18. This vacuum or reduced pressure can be put to any desired use by port 36 and valve 40.

The generation of increased pressure is accomplished in substantially the same manner. Using the example of the operation of the device described above, it should be readily apparent that if valve 38 were closed, the air pressure within the chamber 16 would be increased as the piston 26 was being drawn therein and was being spirally wrapped around the axle 20. The piston would be attempting to displace the air within the chamber 16 but since there would be no communication to the outside atmosphere, the pressure therein would be increased. Again, this increased pressure could be utilized through the port 34. Since both axles 20 and 22 are each provided with a means for rotating the same, the piston 26 can continuously and alternately be drawn into and out of each of the chambers 16 and 18.

Although the foregoing has described the device 10 as a pump for creating a vacuum or increasing pressure, the same could also be used as a motor. For example, by attaching a vacuum source to the port 36, the piston 26 will be drawn into the chamber 18. As a result, the piston will be drawn out of chamber 16 causing axle 20 to rotate. In this way, the device converts pressure into mechanical motion and thereby functions as a motor. With the proper arrangement and interconnections, the invention can also function as an actuator, an accumulator, a lifter, valve, reducer or any one of various other devices.

Figure 4:
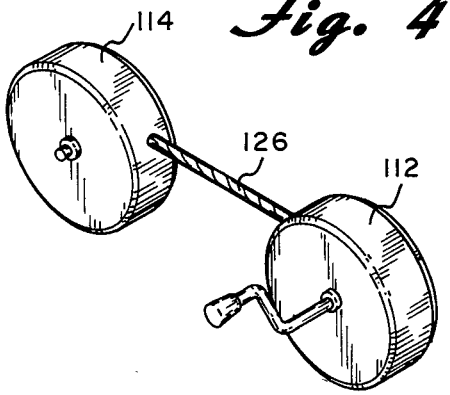
FIG. 4 is a perspective view similar to FIG. 1 but showing an alternative form of the invention.

As should be readily apparent to those skilled in the art, the flexible piston 26 can have substantially any shape. The only requirement is that the cross-sectional configuration of the piston be such that it is complementary to and precisely the same size as the opening in the housing as it passes therethrough so as to provide an airtight seal. Thus, the cross-sectional configuration of the piston can either be constant throughout its entire length or it can vary as long as it is larger than the opening and is compressible so as to fit through the opening in the housing. By way of example, FIG. 4 shows an arrangement which is substantially the same as that shown in FIG. 1 but which utilizes a rope-like flexible piston 126 and a pair of disk-shaped housings 112 and 114. The rope-like piston 126, furthermore, can be either solid or hollow in the form of a tube.

Figure 5:
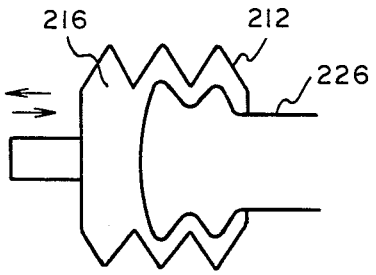
FIG. 5 is a schematic representation of another alternative form of the invention.
Figure 6:
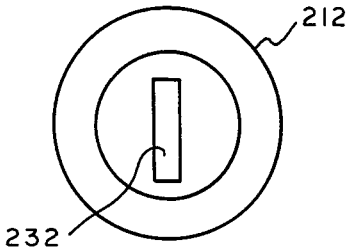
FIG. 6 is a right side view of the embodiment of FIG. 5.
Figure 7:
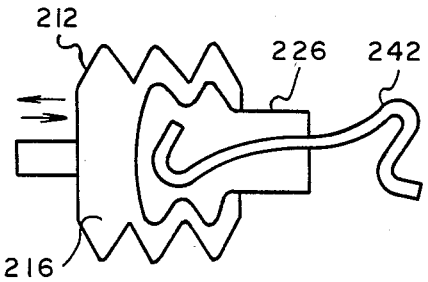
FIG. 7 is a view similar to FIG. 5 but showing a modified form thereof.

FIGS. 5, 6 and 7 show another alternative form of the invention shown in FIGS. 1–4. In these embodiments, the piston 226 is comprised of a flexible, hollow balloon-type member. The chamber 212 may have substantially any shape such as the alternating shape shown in the figures. The opening 232 in the housing 212 preferably is in the form of a slit. It can be seen that as the end of the piston 226 is withdrawn out of the housing 212 through the opening 232, the pressure in the chamber 216 within the housing 212 is reduced thereby creating a vacuum.

As should be apparent to those skilled in the art, as the flexible piston 226 is being withdrawn from the housing 212, the pressure within the piston itself will cause the loss of flexibility creating difficulty. FIG. 7 shows a closed piston with a piston regulator 242 provided to interact with the piston 226 is substantially the same manner that the piston 226 interacts with the housing 212. Thus, as the pressure within the piston 226 causes the loss of flexibility, the regulator 242 can be withdrawn somewhat therefrom to decrease the pressure.

Figure 8:
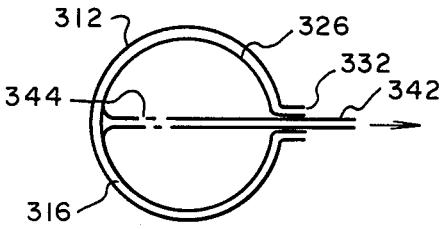
FIG. 8 is a schematic representation of a still further embodiment of the invention.

FIG. 8 illustrates a still further embodiment of the invention which utilizes a substantially spherically shaped housing 312 which has a chamber 316 therein and an opening 332. A flexible balloon-like piston 326 fills the chamber 316. A substantially rigid tubular rod 342 has one end secured to the inside of the piston 326. Adjacent the end of the rod 342 are a plurality of holes 344 for providing communication from the outside atmosphere to the inside of the piston 326.

The embodiment shown in FIG. 8 functions in the following manner. The piston 326 is inserted into the housing 312 through the opening 332 by pushing the same and utilizing the rod 342. After the piston 326 is within the chamber 316, the free end of the piston which lies outside of the housing 312 is held in an airtight manner around the rod 342. Air is then forced into the rod 342 and through the holes 344 to expand the piston 326 against the inner walls of the housing 312. The free end of the piston 326 is then tied in an airtight manner around the opening 332. At this point the rod 342 can then be drawn out of the housing 312 through the opening 332 thereby creating a vacuum in the chamber 316.

Figure 9:
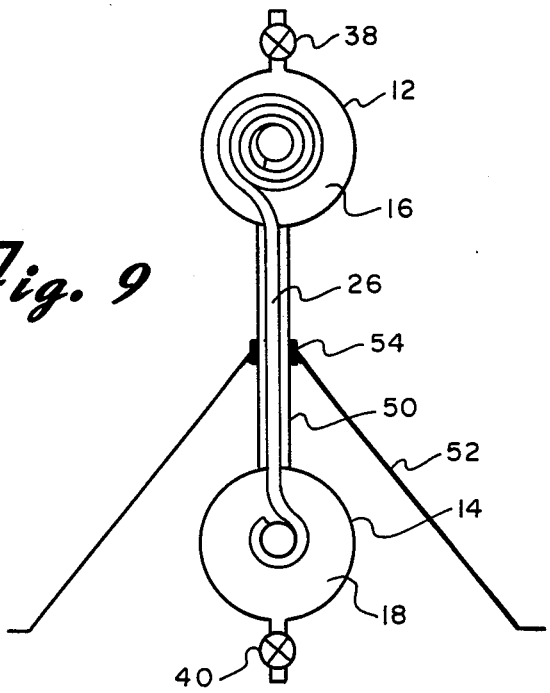
FIG. 9 is a schematic representation of a device similar to FIG. 1 but showing an application thereof.

FIG. 9 is a schematic representation of a possible application of the device shown in FIGS. 1–3. The apparatus of FIG. 1 is slightly modified by connecting the two housings 12 and 14 together by way of an additional elongated housing 50 through which the piston 26 may pass. The entire device is then supported by way of support means 52 under water or in any other variable pressure area. Pivot means 54 are provided so that the entire device can rotate around the support means 52. FIG. 9 illustrates the starting position of the apparatus. Because of the additional weight in the chamber 12 caused by the quantity of the piston 26 therein, the device tends to rotate so that housing 12 falls to the bottom and housing 14 moves to the top. With the housing 12 further under water than the housing 14, the piston 26 will be drawn into the chamber 18 making the housing 14 heavier than housing 12 and the process will repeat itself thereby generating rotary motion.

The present invention may be embodied in other specific forms such as one, two, three or more housings without departing from the spirit or essential attributes thereof and accordingly reference should be made to the appended claims rather than to the foregoing specification as indicating the scope of the invention.

We claim:

1. A pump for selectively creating a vacuum or increasing pressure comprising:

first and second housings including first and second airtight chambers, respectively, therein;

an elongated flexible compressible piston;

an opening in each of said housings leading from the exterior of said housings to said chambers to allow said pistons to pass therethrough, each said opening having a configuration complementary to but smaller than the cross-sectional configuration of said piston whereby said piston is compressed as it passes through said opening and an airtight seal is created between the housing around said opening and said piston;

first and second rotatable axles mounted within said first and second chambers, respectively, one end of said piston being connected to said first axle and the other end of said piston being connected to said second axle, and means extending to the exterior of said housings for rotating said axles for selectively drawing said flexible piston into or out of said chambers by spirally winding said piston onto or unwinding said piston from an axle, whereby when said flexible piston is drawn into one of said chambers, the pressure within that chamber increases and said flexible piston is simultaneously drawn out of the other of said chambers decreasing the pressure in said other chamber.

2. A pump for selectively creating a vacuum or increasing pressure comprising:

a housing including an airtight chamber therein;

an elongated flexible compressible piston;

an opening in said housing leading from the exterior of said housing to said chamber, said opening having a configuration complementary to but smaller than the cross-sectional configuration of said piston whereby said piston is compressed as it passes through said opening and an airtight seal is created between the housing around said opening and said piston;

means for selectively drawing said flexible piston into or out of said chamber whereby, when said flexible piston is drawn into said chamber, the pressure within the chamber increases and, when said flexible piston is drawn out of said chamber, the pressure within the chamber decreases;

a second housing and a second airtight chamber located within said second housing, said second housing also having an opening therein having a shape which is smaller than but complementary to the cross-sectional configuration of said piston, said first and second chambers having first and second rotatable axles respectively mounted therein with the ends of said piston being secured to said axles and being adapted to be spirally wound thereon; whereby when said first-mentioned axle is rotated in a direction to draw said piston into said first-mentioned chamber to wind the piston around the axle, the piston simultaneously unwinds from said second axle and is withdrawn from said second chamber;

means rigidly securing said first and second housings together and means mounting said securing means and said housing for rotation as a unit about a substantially horizontal axis.

* * * * *